US012486730B2

(12) United States Patent
Scaggs et al.

(10) Patent No.: US 12,486,730 B2
(45) Date of Patent: Dec. 2, 2025

(54) SEAL ASSEMBLY WITH SELF-ADJUSTING ACTUATOR

(71) Applicant: Innovex International, Inc., Houston, TX (US)

(72) Inventors: Todd L. Scaggs, Fulshear, TX (US); John Stepchinsky, Spring, TX (US); John Trahan, Houston, TX (US)

(73) Assignee: Innovex International, Inc., Houston, TX (US)

( * ) Notice: Subject to any disclaimer, the term of this patent is extended or adjusted under 35 U.S.C. 154(b) by 0 days.

(21) Appl. No.: 18/432,218

(22) Filed: Feb. 5, 2024

(65) Prior Publication Data

US 2025/0250875 A1 Aug. 7, 2025

(51) Int. Cl.
*E21B 33/04* (2006.01)

(52) U.S. Cl.
CPC ..... *E21B 33/04* (2013.01)

(58) Field of Classification Search
CPC ..... E21B 33/04
See application file for complete search history.

(56) References Cited

U.S. PATENT DOCUMENTS 8,146,670 B2 * 4/2012 Ellis ..... E21B 33/04 166/368
8,186,426 B2 * 5/2012 Nelson ..... E21B 33/04 277/323
9,765,588 B2 * 9/2017 Mansukh ..... E21B 33/04
9,945,201 B2 * 4/2018 Tamosaitis ..... E21B 33/02
10,113,383 B2 * 10/2018 Duong ..... E21B 33/04
10,138,698 B2 * 11/2018 Barnhart ..... E21B 23/02
10,184,311 B2 * 1/2019 Gadre ..... E21B 33/04
10,240,423 B2 * 3/2019 Nguyen ..... E21B 33/04
10,689,935 B2 * 6/2020 Levert, Jr. ..... E21B 23/02
11,970,920 B2 * 4/2024 Guidry ..... F16J 15/12
12,228,001 B2 * 2/2025 Cheng ..... E21B 33/0422
2002/0170721 A1 * 11/2002 June ..... E21B 33/043 166/94.1
2005/0284640 A1 * 12/2005 Borak ..... E21B 33/04 166/75.13
2010/0126736 A1 * 5/2010 Ellis ..... E21B 33/04 166/387

(Continued)

FOREIGN PATENT DOCUMENTS

WO 2016176020 A1 11/2016
WO 2023014585 A1 2/2023

OTHER PUBLICATIONS

Patents Act 1977: Search Report under Section 17(5), GB Application No. GB2501073.7, May 23, 2025, 5 pages.

*Primary Examiner* — Steven A Macdonald
(74) *Attorney, Agent, or Firm* — Baker Botts L.L.P.

(57) ABSTRACT

A system includes a seal assembly configured to retain a casing hanger within a wellhead. The seal assembly includes a main body; a lock ring coupled to the main body and configured to expand radially outward into a profile on an inner diameter of the wellhead; and an actuator, wherein the actuator is capable of transferring an axial force from the actuator into outward radial expansion of the lock ring until a tapered portion of the lock ring directly contacts a corresponding tapered portion of the profile, regardless of an initial distance from the lock ring to the profile prior to actuation of the lock ring.

18 Claims, 6 Drawing Sheets

(56) References Cited

U.S. PATENT DOCUMENTS

| | | | | |
|---|---|---|---|---|
| 2010/0193195 | A1* | 8/2010 | Nguyen | E21B 23/00 166/338 |
| 2012/0024542 | A1* | 2/2012 | Keat | E21B 33/04 166/88.1 |
| 2013/0146306 | A1* | 6/2013 | Yates | E21B 33/0422 166/208 |
| 2013/0299193 | A1* | 11/2013 | Duong | E21B 33/04 166/208 |
| 2015/0068725 | A1* | 3/2015 | Duong | E21B 33/04 166/75.14 |
| 2015/0101830 | A1* | 4/2015 | Sommerfeld | E21B 33/04 166/138 |
| 2018/0100364 | A1* | 4/2018 | Nguyen | E21B 23/01 |
| 2018/0163491 | A1* | 6/2018 | Nguyen | E21B 33/04 |
| 2018/0171733 | A1* | 6/2018 | Nguyen | E21B 33/04 |
| 2018/0258726 | A1* | 9/2018 | Levert, Jr. | E21B 33/04 |
| 2021/0095535 | A1* | 4/2021 | Cheng | E21B 23/01 |
| 2023/0146842 | A1* | 5/2023 | Cheng | E21B 33/0422 166/179 |

* cited by examiner

SEAL ASSEMBLY WITH SELF-ADJUSTING ACTUATOR

TECHNICAL FIELD

The present disclosure relates generally to seal assemblies used to secure a casing hanger within a wellhead and, more particularly, to a seal assembly having a self-adjusting actuator used to rigidize the seal between the casing hanger and the wellhead.

BACKGROUND

Conventional wellhead systems include a wellhead housing and a subsurface casing string extending from the wellhead into the well bore. During a drilling procedure, a drilling riser and BOP are installed above a wellhead housing to provide pressure control as casing is installed, with each casing string having a casing hanger on its upper end for landing on a shoulder within the wellhead housing.

For various reasons, a casing hanger within the wellhead may move axially upward, particularly when the wellhead is part of a production system where downhole fluids at elevated temperatures thermally expand the casing string and thus exert a substantial upward force on the casing hanger. Since the casing hanger seal is intended for sealing at a particular location on the wellhead, upward movement of the casing hanger and the seal assembly is detrimental to reliably sealing the casing annulus. A lockdown component can be used to prevent axial movement of the casing hanger in response to such axial forces.

Various types of lockdown components have been conceived for axially interconnecting a casing hanger and a subsea wellhead. The lockdown component (e.g., a lockdown sleeve) may be incorporated into the seal assembly. Such a seal assembly, once run in and locked into the wellhead, prevents axial (i.e., vertical) movement of the uppermost casing hanger and the seal with respect to the wellhead. Typically, a seal assembly is run into the wellhead on an associated running tool, landed on the casing hanger, and locked to a locking profile on an inner wall of the wellhead housing to axially secure the casing hanger within the wellhead. To install conventional seal assemblies, it is first necessary to run a lead impression tool into the wellhead to measure the distance between the top of the casing hanger and the housing locking profile. After retrieving the lead impression tool to the surface, the measured dimension can be obtained. With this information, the seal assembly length can be adjusted at the surface so that once the seal assembly is run in and secured to the wellhead, it provides a zero-gap connection between the casing hanger and the wellhead housing and any desired pre-load.

This process of taking measurements in the wellhead via a lead impression tool, retrieving the tool to the surface, and then adjusting and installing a seal assembly into the wellhead is a time-consuming installation process requiring multiple trips into the wellhead. It is now recognized that a need exists for a seal assembly that can be adjusted once it is already landed in the wellhead.

BRIEF DESCRIPTION OF THE DRAWINGS

For a more complete understanding of the present disclosure and its features and advantages, reference is now made to the following description, taken in conjunction with the accompanying drawings, in which.

DETAILED DESCRIPTION

Figure 1:
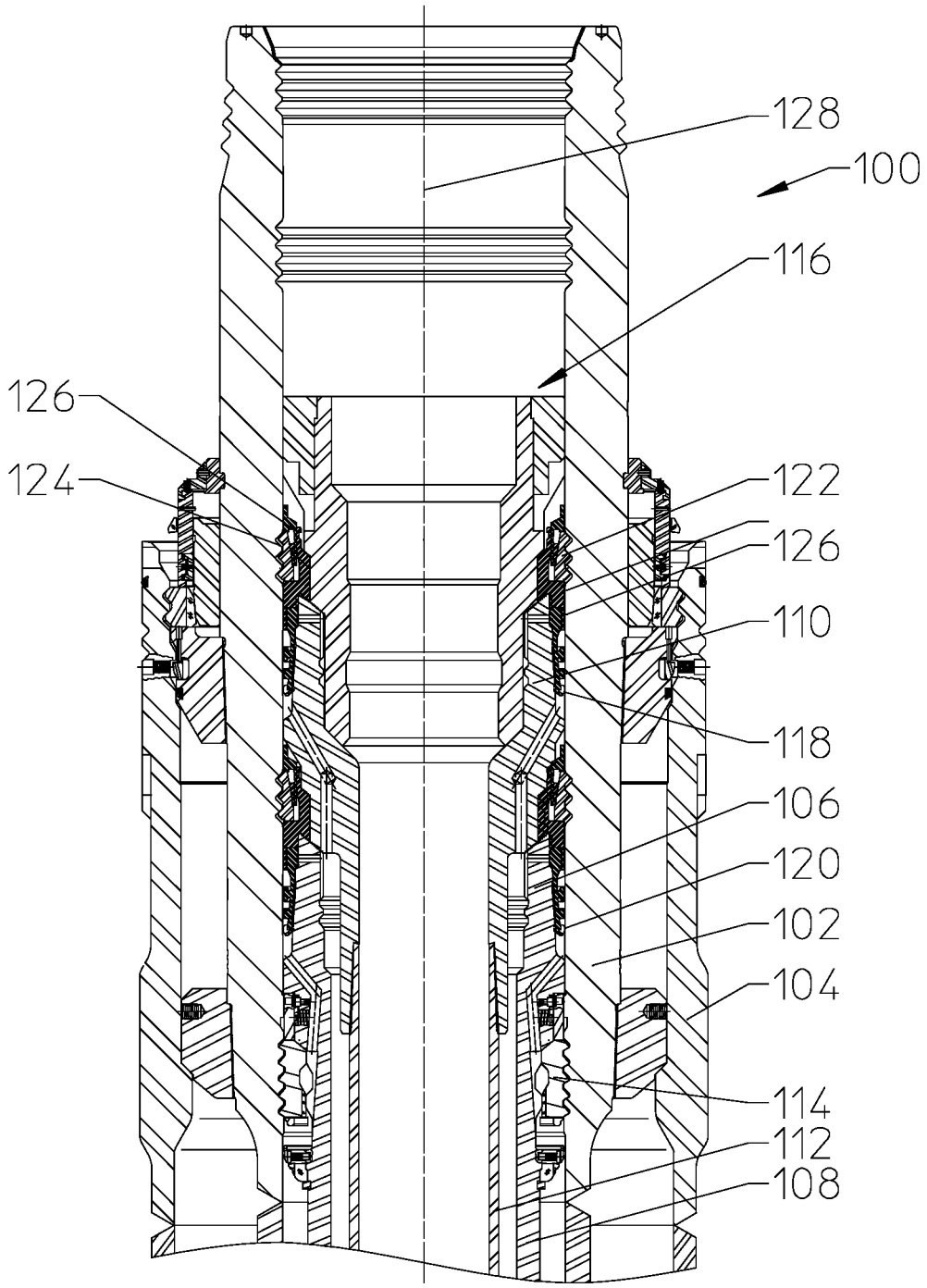
FIG. 1 is a cross-sectional view of a system including a casing hanger secured in a wellhead using a seal assembly with a self-adjusting actuator for rigidizing a seal, in accordance with an embodiment of the present disclosure.

Illustrative embodiments of the present disclosure are described in detail herein. In the interest of clarity, not all features of an actual implementation are described in this specification. It will of course be appreciated that in the development of any such actual embodiment, numerous implementation specific decisions must be made to achieve developers' specific goals, such as compliance with system related and business related constraints, which will vary from one implementation to another. Moreover, it will be appreciated that such a development effort might be complex and time consuming, but would nevertheless be a routine undertaking for those of ordinary skill in the art having the benefit of the present disclosure. Furthermore, in no way should the following examples be read to limit, or define, the scope of the disclosure.

Certain embodiments of the present disclosure may be directed to a seal assembly equipped with a self-adjusting actuator for rigidizing a seal.

A seal assembly may be used to position a seal between a casing hanger and a wellhead housing and to axially interconnect the casing hanger to the wellhead. The seal assembly may be locked into the wellhead, thereby preventing axial movement of the casing hanger, and the seal, with respect to the wellhead.

In some cases, machining tolerances may give rise to small gaps between a locking mechanism (e.g., lock ring) of the seal assembly and an upper edge of a complementary lock profile of the wellhead when the seal assembly is landed and locked to seal the annulus between the casing hanger and the wellhead. Such gaps may allow the seal located between the casing hanger and the wellhead to move up and down axially in response to pressure differentials. Over time, this motion of the seal can cause undesirable wear on the seal.

The disclosed seal assembly overcomes these deficiencies by using a self-adjusting actuator to prevent any such axial gaps while actuating the lock ring, thereby rigidizing the system. The seal assembly is configured to retain a casing hanger within a wellhead. The seal assembly generally includes a main body, a lock ring coupled to the main body, and an actuator for actuating the lock ring. The lock ring is configured to expand radially outward into a profile on an inner diameter of the wellhead. The actuator is capable of transferring an axial force from the actuator into outward radial expansion of the lock ring until a tapered portion of the lock ring directly contacts a corresponding tapered portion of the profile, regardless of an initial distance from the lock ring to the profile prior to actuation of the lock ring. Thus, the actuator is self-adjusting to fit the location that the lock ring extends into the wellhead profile. Expanding the lock ring directly against the corresponding tapered portion(s) of the wellhead profile prevents an axial gap from forming between the lock ring and the wellhead profile (while maintaining any desired pre-load), thus rigidizing the seal. The seal assembly having the lock ring is landed directly on the casing hanger and, as such, has a position with respect to the wellhead that is based on the relative position of the casing hanger in the wellhead. Because the actuator can self-adjust to rigidize the seal regardless of the positioning of the casing hanger in the wellhead, the same pre-load may be applied even if the casing hanger is sitting higher or lower in the wellhead.

The installation process for the seal assembly may be accomplished during one trip into the wellhead, as opposed to a first trip with a lead impression tool followed by an adjustment of a lockdown component of the seal assembly at the surface and a subsequent trip downhole to install the adjusted seal assembly. The disclosed systems and method provide both time savings (since only one trip into the wellhead is necessary) and cost savings (since an additional lead impression tool is not required) compared to existing seal assembly installation techniques. In addition, the seal assembly having a self-adjusting actuator is relatively simple to construct and operate compared to other, more complicated lockdown assemblies that utilize rotating components, etc. All these and other advantages will be apparent based on the following description.

Turning now to the drawings, FIG. 1 illustrates certain components of a wellhead system 100. The illustrated system 100 may include a subsea wellhead assembly. However, similar techniques may be used in land-based wellhead systems as well. The wellhead assembly may include a wellhead 102 (with high-pressure housing), an outer low-pressure housing 104, a lower casing hanger 106 landed within the wellhead 102 and supporting an outer casing string 108, and an upper casing hanger 110 landed on the lower casing hanger 106 and supporting an inner casing string 112. A c-ring 114 or other attachment mechanism may support the lower casing hanger 106 and thus the outer casing string 108 from the wellhead 102.

A seal assembly 116 may be installed in the wellhead 102 and used for retaining the upper casing hanger 110 within the wellhead 102. In particular, the seal assembly 116 may be installed at an interface of the top of the upper casing hanger 110 and the wellhead 102. The seal assembly 116 may include a seal 118 at a lower end thereof. The seal 118 may seal between the upper portion of the upper casing hanger 110 and the wellhead 102, thereby sealing the annulus about the inner casing string 112. The lower casing hanger 106 may have its own seal 120 as well for sealing with the wellhead 102. The wellhead 102, casing strings, and casing hangers as described are functionally similar to existing wellhead and casing hanger technologies. The wellhead system 100 in FIG. 1 is typically used during production operations, and frequently a blowout preventer (BOP) or tieback connector is provided at the upper end of the wellhead 102.

In addition to positioning the seal 118, the seal assembly 116 is configured to prevent axial movement between the upper casing hanger 110 (and the seal 118) and the wellhead 102. The seal assembly 116 includes a lock ring (or similar locking component) 122 that locks into an internal locking profile 124 on a bore of the wellhead 102. The seal assembly 116 may be landed on the upper casing hanger 110 to secure and/or provide a pre-load to the casing hanger 110 in a downward direction.

The seal assembly 116 further includes a self-adjusting actuator 126 configured to prevent any gap from forming in an axial direction (e.g., parallel to axis 128 of the wellhead 102) between the lock ring 122 and an upper edge of the internal locking profile 124. Preventing any such gap via the actuation of the lock ring 122 using the self-adjusting actuator 126 rigidizes the seal 118 with respect to the wellhead 102. Once the seal assembly 116 is installed (i.e., landed and locked via the self-adjusting actuator 126 and lock ring 122), the seal 118 and the casing hanger 110 are prevented from moving upward or downward with respect to the wellhead 102 via the connection of the seal assembly 116 with the casing hanger 110 and the wellhead 102. Thus, the disclosed system may deter movement of the seal 118 in an axial direction via the connection between the casing hanger 110, the seal assembly 116, and the wellhead 102.

FIGS. 2A-5 illustrate various seal assemblies (116A-D) that may be used in the wellhead system 100 of FIG. 1. The seal assemblies (116A-D) include different types of self-adjusting actuators (126A-D, respectively) used to actuate the lock ring 122 and rigidize the seal 118 of the seal assembly (116A-D). In each of FIGS. 2A-5, the seal assembly (116A-D) generally includes a main body 200, the lock ring 122, and the actuator (126A-D). The lock ring 122 is coupled to the main body 200 and configured to expand radially outward (relative to the main body 200) into the profile 124 on an inner diameter 202 of the wellhead 102. The actuator (126A-D) is capable of transferring an axial force from the actuator (126A-D) into outward radial expansion of the lock ring 122 until a tapered portion 204 of the lock ring 122 directly contacts a corresponding tapered portion 206 of the profile 124, regardless of an initial distance from the lock ring 122 to the profile 124 prior to actuation of the lock ring 122. The actuator (126A-D) may take the form of an actuator sleeve that, when pushed downward, causes the lock ring 122 to expand radially outward. Different constructions and functions of the actuator (126A-D) will be described in greater detail below.

In general, the lock ring 122 may be a radially expandable split ring having a radially outer profile 208 configured to match the profile 124 on the wellhead 102. A radially expandable split ring is a ring of material having a substantially consistent cross-section, with the ring being non-continuous (e.g., having a break at one circumferential position of the ring). This break in the ring allows the lock ring 122 to expand radially outward in response to force from the actuator (126A-D).

In FIGS. 2A-5, the seal assembly (116A-D) may also include the seal 118 coupled to the main body 200. As illustrated, the seal 118 may form a lower portion of the seal assembly (116A-D) that is coupled (e.g., via threads 210) to a lower end of the main body 200. As discussed above, the seal 118 may be used for sealing an annulus between the casing hanger 110 and the wellhead 102.

A general description of the process of installing the seal assembly (116A-D) and rigidizing the seal 118 will now be provided.

First, the seal assembly (116A-D) is positioned into the wellhead 102. For example, the seal assembly (116A-D) may be positioned such that the main body 200 lands on the casing hanger 110 and the seal 118 is disposed between the casing hanger 110 and the wellhead 102. The seal assembly (116A-D) may be run into the wellhead 102 on an associated running tool 212 until it is landed on the casing hanger 110. The seal assembly (116A, 116B) is shown in the landed configuration in FIGS. 2A and 3.

Figure 4:
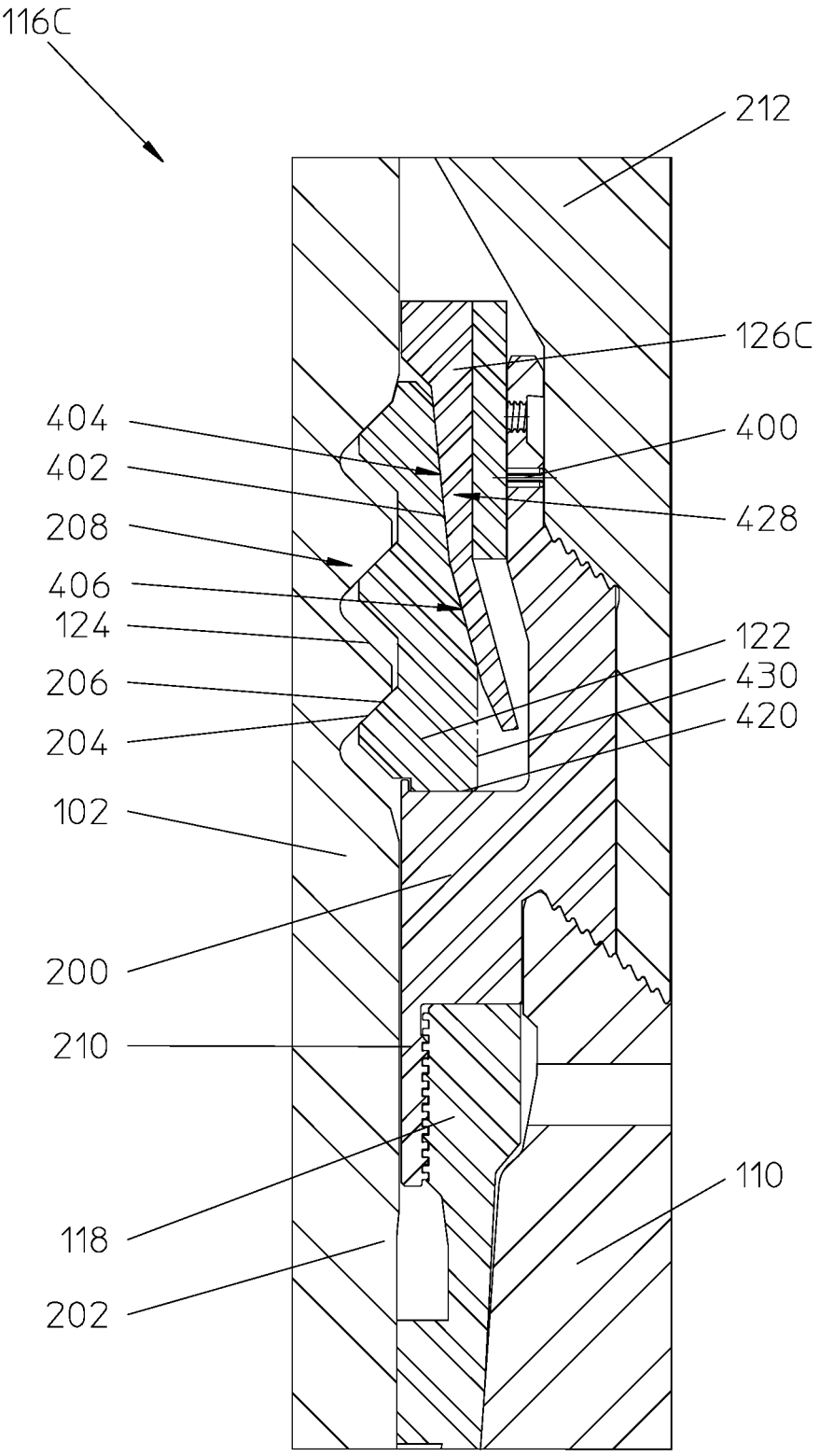
FIG. 4 is a cross-sectional view of another seal assembly having a self-adjusting actuator in an actuated position, in accordance with an embodiment of the present disclosure.
Figure 5:
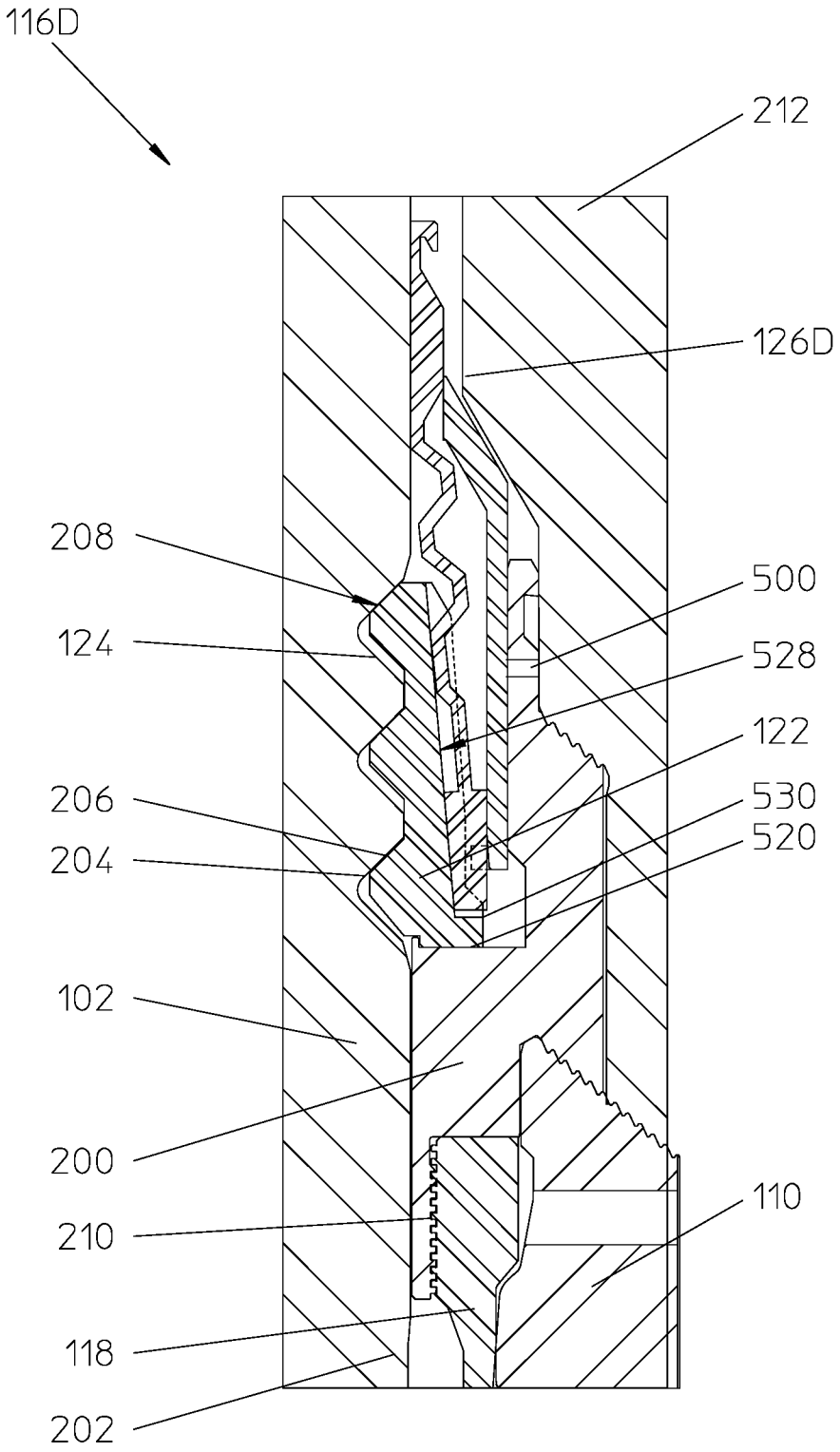
FIG. 5 is a cross-sectional view of another seal assembly having a self-adjusting actuator in an actuated position, in accordance with an embodiment of the present disclosure.

Once the seal assembly (116A-D) is landed on the casing hanger 110, the actuator (126A-D) may be used to set the lock ring 122. In particular, the lock ring 122 may be actuated toward the internal locking profile 124 on the inner diameter 202 of the wellhead 102 via the actuator (126A-D). This involves moving at least a portion of the actuator (126A-D) in an axial (e.g., vertically downward) direction with respect to the main body 200 to contact the lock ring 122. The movable portion(s) of the actuator (126A-D) may be pushed downward via a setting force from weight or hydraulic fluid. The movable portion(s) of the actuator (126A-D) may be connected (e.g., via rods/fingers extending through slots) to a piston, sleeve, or other movable component located in the running tool 212 and/or in a stationary portion of the actuator (126A-D). The actuator (126A-D) expands the lock ring 122 radially outwardly into the profile 124 on the inner diameter of the wellhead 102. The lock ring 122 and actuator (126A-D) may include interfacing surfaces that enable transfer of axial (i.e., downward) force from the actuator (126A-D) into outward radial expansion of the lock ring 122. FIGS. 2B, 4, and 5 show the lock ring 122 in its radially expanded position.

As shown, in the expanded position, at least one tapered upward facing surface (tapered portion 204) on the profile of the lock ring 122 is in direct contact with a corresponding tapered downward facing surface (tapered portion 206) on the profile 124 of the wellhead 102. Using the disclosed actuator (126A-D), the profile 208 of the lock ring 122 is pushed into direct contact with the profile 124 of the wellhead 102 in this manner, regardless of an initial axial positioning of the lock ring 122 relative to the profile 124 prior to actuation of the lock ring 122. No gap is present in the axial direction (e.g., parallel to axis 128 of FIG. 1) between the tapered upward facing surface(s) of the lock ring 122 and the complementary tapered downward facing surface(s) of the profile 124 after actuation of the lock ring 122. After the lock ring 122 is set in this manner, additional axial force may be applied to the actuator (126A-D) and transferred to the lock ring 122, thereby applying a desired pre-load to the casing hanger 110 via the seal assembly (116A-D).

With the lock ring 122 expanded radially outwardly by the actuator (126A-D), the seal assembly (116A-D) is in a fully locked and rigidized configuration within the wellhead 102. In this position, the seal assembly (116A-D) is able to retain the casing hanger 110 in the wellhead 102 and rigidize the connection between the casing hanger 110, the wellhead 102, and the seal 118. With the rigidized connection, the seal 118 is sealing the annulus between the casing hanger 110 and the wellhead 102, and the connection deters movement of the seal 118 in an axial direction.

Different variations of the actuator (126A-D) will now be described.

Figure 2A:
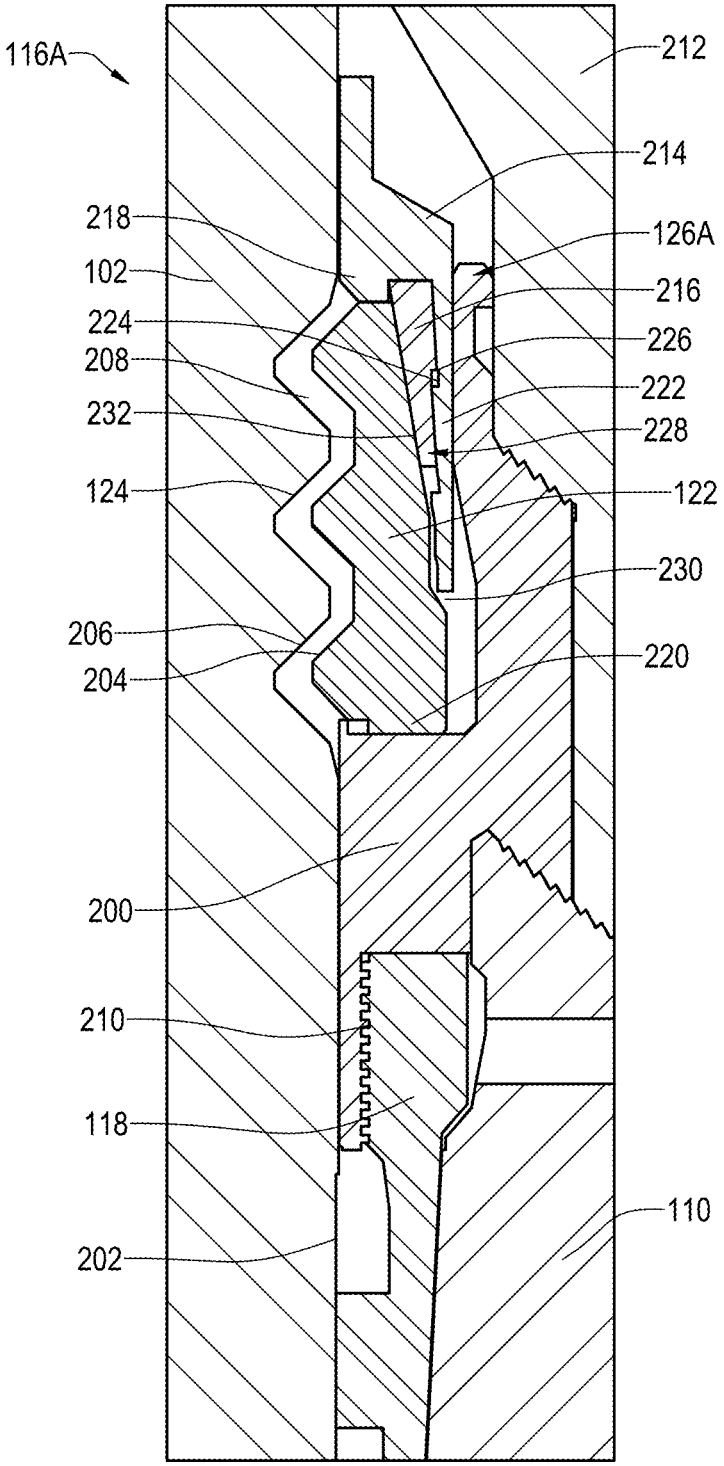
FIGS. 2A and 2B are a cross-sectional views of a seal assembly having a self-adjusting actuator, with the actuator in an unactuated position in FIG. 2A and the actuator in an actuated position in FIG. 2B, in accordance with an embodiment of the present disclosure.
Figure 2B:
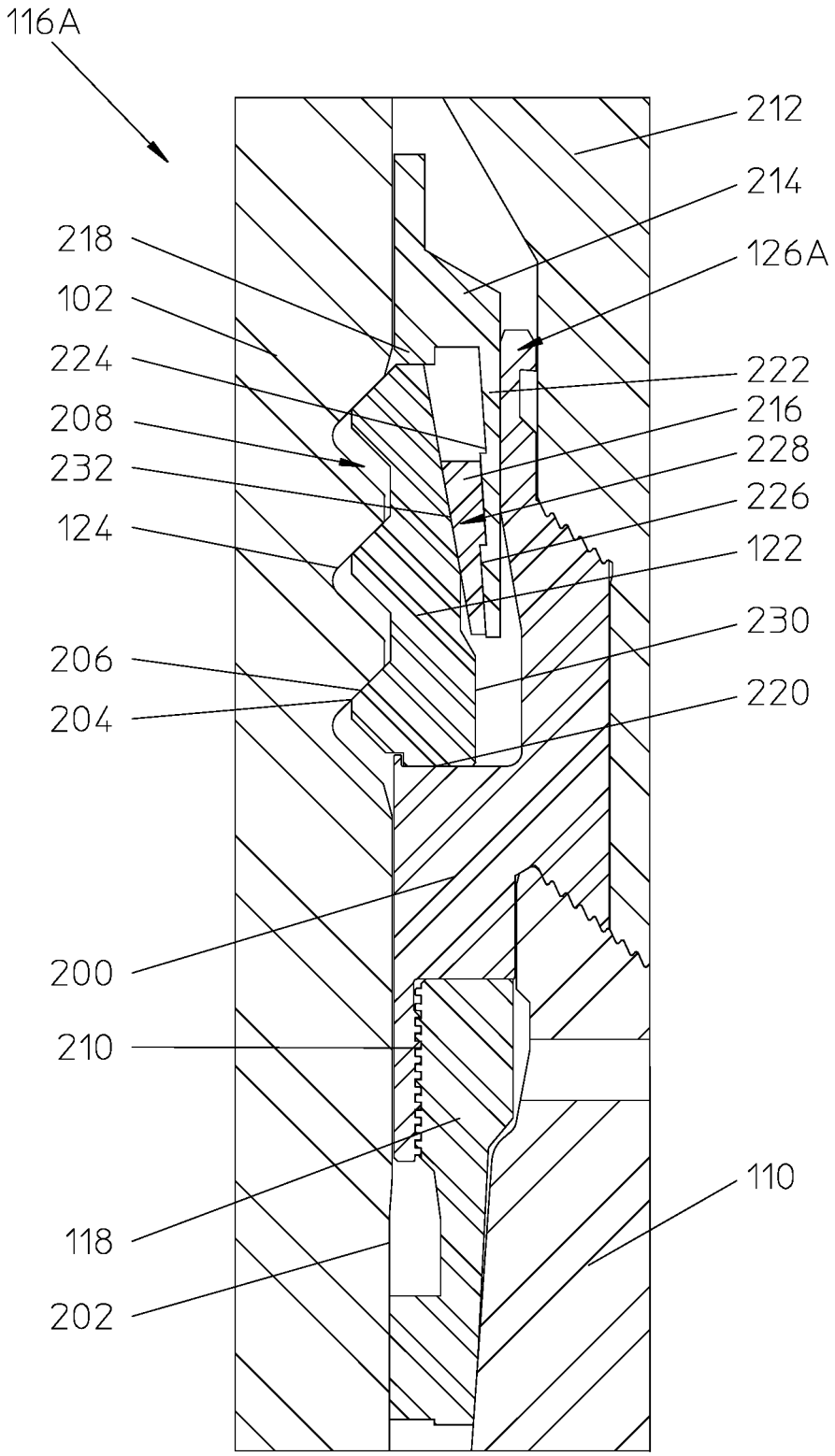

FIGS. 2A and 2B illustrate a seal assembly 116A with an actuator 126A that may be used to set the lock ring 122. In particular, FIG. 2A shows the actuator 126A in an unactuated position and FIG. 2B shows the actuator 126A in an actuated position. As illustrated, the actuator 126A includes a first portion 214 and a second portion 216. The first portion 214 is configured to remain stationary with respect to the main body 200 during actuation of the lock ring 122, while the second portion 216 is configured to be moved in the axial direction (i.e., downward) with respect to the first portion 214 for actuating the lock ring 122. The first portion 214 may provide support and guidance for the second portion 216 as the second portion 216 is pushed downward (e.g., via hydraulic fluid or a structural component from above). As shown, part of the first portion 214 (e.g., a shoulder 218) is disposed directly above the lock ring 122, holding the lock ring 122 in an axially constrained position between the shoulder 218 and an upward facing surface 220 of the main body 200 prior to (FIG. 2A), during, and after (FIG. 2B) actuation of the lock ring 122. The first portion 214 may have an axial arm 222 extending downward on a radially inward side of the second portion 216.

As shown, the interface between the first portion 214 and the second portion 216 of the actuator 126A may include a stepped profile. For example, the first portion 214 may have a stepped profile 224 on a radially outward facing side of the axial arm 222 and the second portion 216 may have a corresponding stepped profile 226 on its radially inward facing side. The stepped profile may guide downward movement of the second portion 216 with respect to the first portion 214. The stepped profiles 224 and 226 may be complementary in shape, and the stepped profiles 224 and 226 may have steps or shoulders formed therein to enable gradual movement of the second portion 216 with respect to the first portion 214. In certain embodiments, the steps or shoulders may be tapered, thereby providing a relatively smooth transitioning of the second portion 216 in the axial direction from the initial, unactuated position (FIG. 2A) to the lower, actuated position (FIG. 2B). The stepped profile interface used to direct the second portion 216 of the actuator 126A down with respect to the stationary first portion 214 may serve to maintain the second portion 216 in a lowered, actuated position after the lock ring 122 is first locked to the profile 124 of the wellhead 102.

As shown, the lock ring 122 may include a tapered portion 228 along its radially inward facing surface 230. In the illustrated embodiment, only part (tapered portion 228) of the radially inward facing surface 230 is tapered. In other embodiments, the entire inward facing surface 230 of the lock ring 122 may be tapered. The second portion 216 of the actuator 126A may have a tapered radially outward facing surface 232 configured to interface with the tapered portion 228 of the lock ring 122. This tapered interface between the second portion 216 and the lock ring 122 is configured to transfer axial force from the second portion 216 of the actuator 126A into radially outward force on the lock ring 122.

As shown in FIGS. 2A and 2B, actuation of the lock ring 122 is accomplished through moving the second portion 216 of the actuator 126A in the axial direction (i.e., downward) while maintaining the first portion 214 stationary with respect to the main body 200. This moves the stepped profile 226 of the second portion 216 with respect to the stepped profile 224 of the first portion 214.

The seal assembly 116A may be landed at a location with respect to the wellhead 102 dictated by the position of the casing hanger 110 in the wellhead 102. Then, the actuator 126A self-adjusts via movement of the second portion 216 with respect to the first portion 214 to expand the lock ring 122 into full engagement (with no axial gap) with the profile 124 of the wellhead 102, regardless of the initial axial positioning of the casing hanger 110 in the wellhead 102.

Figure 3:
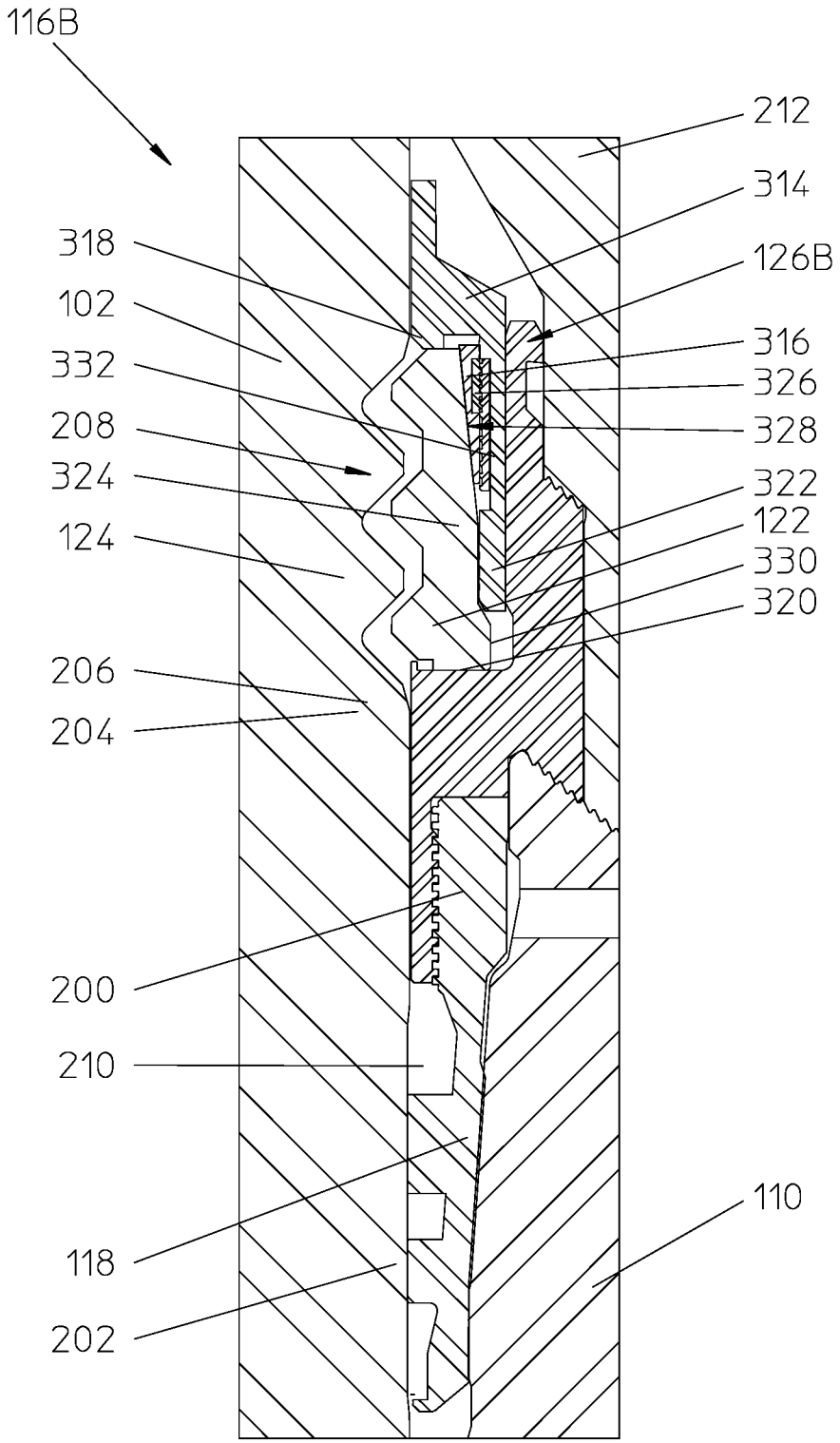
FIG. 3 is a cross-sectional view of another seal assembly having a self-adjusting actuator in an unactuated position, in accordance with an embodiment of the present disclosure.

FIG. 3 illustrates a seal assembly 116B with another type of actuator 126B that may be used to set the lock ring 122. FIG. 3 shows the actuator 126B in an unactuated position. Similar to the embodiment of FIGS. 2A and 2B, the actuator 126B in FIG. 3 includes a first portion 314 and a second portion 316. The first portion 314 is configured to remain stationary with respect to the main body 200 during actuation of the lock ring 122, while the second portion 316 is configured to be moved in the axial direction (i.e., downward) with respect to the first portion 314 for actuating the lock ring 122. The first portion 314 may provide support and guidance for the second portion 316 as the second portion 316 is pushed downward (e.g., via hydraulic fluid or a structural component from above). As shown, part of the first portion 314 (e.g., a shoulder 318) is disposed directly above the lock ring 122, holding the lock ring 122 in an axially constrained position between the shoulder 318 and an upward facing surface 320 of the main body 200 prior to (FIG. 3), during, and after actuation of the lock ring 122. The first portion 314 may have an axial arm 322 extending downward on a radially inward side of the second portion 316.

As shown, the interface between the first portion 314 and the second portion 316 of the actuator 126B may include ratcheting threads. For example, the first portion 314 may have a first set of threads 324 on a radially outward facing side of the axial arm 322 and the second portion 316 may have a corresponding second set of threads 326 on its radially inward facing side. The ratcheting threads (threads 324 and 326) may guide downward movement of the second portion 316 with respect to the first portion 314. In particular, moving the second portion 316 with respect to the first portion 314 includes ratcheting the threads 326 of the second portion 316 along corresponding threads 324 of the first portion 314. The threads 324 and 326 may be tapered threads that enable the threads 326 on the second portion 316 to easily pass over the threads 324 on the first portion 314 while the second portion 316 moves downward relative to the first portion 314, but substantially prevent movement of the second portion 316 in the opposite direction (i.e., upward) with respect to the first portion 314. Such tapered threads may provide a relatively smooth transitioning of the second portion 216 in the axial direction from the initial, unactuated position (FIG. 3) to the lower, actuated position. Ratcheting the second portion 316 of the actuator 126B down with respect to the stationary first portion 314 may serve to maintain the second portion 316 in a lowered, actuated position after the lock ring 122 is first locked to the profile 124 of the wellhead 102.

As shown, the lock ring 122 may include a tapered portion 328 along its radially inward facing surface 330. In the illustrated embodiment, only part (tapered portion 328) of the radially inward facing surface 330 is tapered. In other embodiments, the entire inward facing surface 330 of the lock ring 122 may be tapered. The second portion 316 of the actuator 126B may have a tapered radially outward facing surface 332 configured to interface with the tapered portion 328 of the lock ring 122. This tapered interface between the second portion 316 and the lock ring 122 is configured to transfer axial force from the second portion 316 of the actuator 126B into radially outward force on the lock ring 122.

Actuation of the lock ring 122 is accomplished through moving the second portion 316 of the actuator 126B in the axial direction (i.e., downward) while maintaining the first portion 314 stationary with respect to the main body 200. This moves the ratchet threads 326 of the second portion 316 with respect to the ratchet threads 324 of the first portion 314.

The seal assembly 116B may be landed at a location with respect to the wellhead 102 dictated by the position of the casing hanger 110 in the wellhead 102. Then, the actuator 126B self-adjusts via movement of the second portion 316 with respect to the first portion 314 to expand the lock ring 122 into full engagement (with no axial gap) with the profile 124 of the wellhead 102, regardless of the initial axial positioning of the casing hanger 110 in the wellhead 102.

FIG. 4 illustrates a seal assembly 116C with another type of actuator 126C that may be used to set the lock ring 122. FIG. 4 shows the actuator 126C in an actuated position. Unlike in the embodiments of FIGS. 2A-3, the actuator 126C in FIG. 4 includes a solid piece of material configured to be deformed upon actuation of the lock ring 122. The entire actuator 126C may be configured to be moved in the axial direction (i.e., downward) with respect to the main body 200 for actuating the lock ring 122. Prior to actuation, the actuator 126C may be coupled to the main body 200 and thereby held at a particular axial position with respect to the main body 200 by one or more shearable components 400 (e.g., shear pin(s)). The actuator 126C may be pushed downward (e.g., via hydraulic fluid or a structural component from above) to actuate the lock ring 122. The actuator 126C may hold the lock ring 122 in an axially constrained position between the actuator 126C/profile 124 and an upward facing surface 420 of the main body 200 after actuation (FIG. 4) of the lock ring 122.

The actuator 126C may include a radially outward facing surface 402 including at least one tapered portion. For example, as illustrated in FIG. 4, the radially outward facing surface 402 of the actuator 126C includes two tapered portions 404 and 406, the tapered portions 404 and 406 being tapered at different angles. The tapered portion 404 may be an upper tapered portion, while the tapered portion 406 is a lower tapered portion located beneath the tapered portion 404. As shown, the tapered portion 406 located lower on the actuator 126C may be tapered at a greater angle (with respect to a vertical direction) than the tapered portion 404 located higher on the actuator 126C. As such, the actuator 126C is able to quickly push out the lock ring 122 (power stroke) with the lower tapered portion 406 and then make up the rest of the connection between the lock ring 122 and the profile 124 more slowly with the shallow upper tapered portion 404. In other embodiments, the radially outward facing surface 402 of the actuator 126C may only feature one tapered portion (e.g., a continuous taper along the length of the actuator 126C).

As shown, the lock ring 122 may include at least one tapered portion 428 along its radially inward facing surface 430. In the illustrated embodiment, only part (tapered portion(s) 428) of the radially inward facing surface 430 is tapered. In other embodiments, the entire inward facing surface 430 of the lock ring 122 may be tapered. The tapered portions 404 and 406 of the actuator 126C are configured to interface with the tapered portion(s) 428 of the lock ring 122. In an example, the tapered portion 428 of the lock ring 122 may have the same or a different angle with respect to vertical as the upper tapered portion 404 of the actuator 126C. In an example, the tapered portion 428 of the lock ring 122 may have the same or a different angle with respect to vertical as the lower tapered portion 406 of the actuator 126C. In another example, the lock ring 122 may include multiple tapered portions 428, each having different angles with respect to vertical, and these angles may be the same or different than the angles of the tapered portions 404 and 406 of the actuator 126C. The tapered interface between the actuator 126C and the lock ring 122 is configured to transfer axial force from the actuator 126C into radially outward force on the lock ring 122. For example, the lower tapered portion 406 may be engaged with the tapered portion 428 of the lock ring 122 to push the lock ring 122 in a radially outward direction, and then the upper tapered portion 404 may be engaged with the tapered portion 428 of the lock ring 122.

The actuator 126C may deform in response to pushing the actuator 126C into contact with the lock ring 122. This may be the case, in particular, when the angle(s) of the tapered portion(s) of the actuator 126C are different from the angle(s) of the tapered portion(s) 428 of the lock ring 122. Deforming the actuator 126C may serve to maintain the actuator 126C in a lowered, actuated position after the lock ring 122 is first locked to the profile 124 of the wellhead 102.

The seal assembly 116C may be landed at a location with respect to the wellhead 102 dictated by the position of the casing hanger 110 in the wellhead 102. Then, the actuator 126C self-adjusts via movement and deformation of the actuator 126C to expand the lock ring 122 into full engagement (with no axial gap) with the profile 124 of the wellhead 102, regardless of the initial axial positioning of the casing hanger 110 in the wellhead 102.

FIG. 5 illustrates a seal assembly 116D with another type of actuator 126D that may be used to set the lock ring 122. FIG. 5 shows the actuator 126D in an actuated position. Similar to the embodiment of FIG. 4, the actuator 126D in FIG. 5 includes a solid piece of material configured to be deformed upon actuation of the lock ring 122. The entire actuator 126D may be configured to be moved in the axial direction (i.e., downward) with respect to the main body 200 for actuating the lock ring 122. Prior to actuation, the actuator 126D may be coupled to the main body 200 and thereby held at a particular axial position with respect to the main body 200 by one or more shearable components 500 (e.g., shear pin(s)). The actuator 126D may be pushed downward (e.g., via hydraulic fluid or a structural component from above) to actuate the lock ring 122. The actuator 126D may hold the lock ring 122 in an axially constrained position between the actuator 126D/profile 124 and an upward facing surface 520 of the main body 200 after actuation (FIG. 5) of the lock ring 122.

The actuator 126D may have any desired shape that fits within the space between the main body 200 and the lock ring 122 prior to actuation of the lock ring 122, as long as the shape is large enough to be forced to deform upon downward movement of the actuator 126D relative to the main body 200 and the lock ring 122. As shown in FIG. 5, the actuator 126D may buckle as it moves downward through this space to set the lock ring 122, thereby maintaining the lock ring 122 in the fully expanded position against the profile 124 of the wellhead 102.

As shown, the lock ring 122 may include one or more tapered portions 528 along its radially inward facing surface 530. In other embodiments, the lock ring 122 may have a radially inward facing surface 530 that is entirely vertical. In the illustrated embodiment, only part (tapered portion 528) of the radially inward facing surface 530 is tapered. In other embodiments, the entire inward facing surface 530 of the lock ring 122 may be tapered. The actuator 126D is configured to interface with the tapered portion 528 of the lock ring 122. The interface between the actuator 126D and the lock ring 122 is configured to transfer axial force from the actuator 126D into radially outward force on the lock ring 122.

As discussed above, the actuator 126D may deform in response to pushing the actuator 126D into contact with the lock ring 122. Deforming the actuator 126D may serve to maintain the actuator 126D in a lowered, actuated position after the lock ring 122 is first locked to the profile 124 of the wellhead 102.

The seal assembly 116D may be landed at a location with respect to the wellhead 102 dictated by the position of the casing hanger 110 in the wellhead 102. Then, the actuator 126D self-adjusts via movement and deformation of the actuator 126D to expand the lock ring 122 into full engagement (with no axial gap) with the profile 124 of the wellhead 102, regardless of the initial axial positioning of the casing hanger 110 in the wellhead 102.

Other illustrative embodiments ("Embodiments") are described below:

Embodiment 1: A system, including: a seal assembly configured to retain a casing hanger within a wellhead, the seal assembly including: a main body; a lock ring coupled to the main body and configured to expand radially outward into a profile on an inner diameter of the wellhead; and an actuator capable of transferring an axial force from the actuator into outward radial expansion of the lock ring, the actuator including: a first portion configured to remain stationary with respect to the main body during actuation of the lock ring; and a second portion configured to be moved in an axial direction with respect to the first portion for actuating the lock ring.

Embodiment 2: A system, including: a seal assembly configured to retain a casing hanger within a wellhead, the seal assembly including: a main body; a lock ring coupled to the main body and configured to expand radially outward into a profile on an inner diameter of the wellhead, the lock ring having a tapered portion along its radially inward facing surface; and an actuator capable of transferring an axial force from the actuator into outward radial expansion of the lock ring, the actuator including a radially outward facing surface including two tapered portions, the two tapered portions being at different angles.

Embodiment 3: A system, including: a seal assembly configured to retain a casing hanger within a wellhead, the seal assembly including: a main body; a lock ring coupled to the main body and configured to expand radially outward into a profile on an inner diameter of the wellhead; and an actuator capable of transferring an axial force from the actuator into outward radial expansion of the lock ring, the actuator including a solid piece of material configured to be deformed upon actuation of the lock ring.

Although the present disclosure and its advantages have been described in detail, it should be understood that various changes, substitutions and alterations can be made herein without departing from the spirit and scope of the disclosure as defined by the following claims.

What is claimed is:

1. A system, comprising:

a seal assembly configured to retain a casing hanger within a wellhead, the seal assembly comprising:

a main body;

a lock ring coupled to the main body and configured to expand radially outward into a profile on an inner diameter of the wellhead; and an actuator, wherein the actuator is capable of transferring an axial force from the actuator into outward radial expansion of the lock ring until a tapered portion of the lock ring directly contacts a corresponding tapered portion of the profile;

wherein the actuator comprises:

a first portion configured to remain stationary with respect to the main body during actuation of the lock ring; and a second portion configured to be moved in an axial direction with respect to the first portion for actuating the lock ring, wherein a shoulder of the first portion is disposed directly above the lock ring, and wherein the lock ring is axially constrained between the shoulder and an upward facing surface of the main body.

2. The system of claim 1, wherein:

the lock ring has a tapered portion along its radially inward facing surface;

the second portion of the actuator has a tapered radially outward facing surface configured to interface with the tapered portion of the lock ring; and an interface between the first portion and the second portion of the actuator comprises a stepped profile.

3. The system of claim 1, wherein:

the lock ring has a tapered portion along its radially inward facing surface;

the second portion of the actuator has a tapered radially outward facing surface configured to interface with the tapered portion of the lock ring; and an interface between the first portion and the second portion of the actuator comprises ratcheting threads.

4. The system of claim 1, wherein:

the lock ring has a tapered portion along its radially inward facing surface; and the actuator comprises a radially outward facing surface comprising two tapered portions, the two tapered portions being at different angles.

5. The system of claim 4, wherein the two tapered portions comprise an upper tapered portion and a lower tapered portion located beneath the upper tapered portion, wherein the lower tapered portion is tapered at a greater angle than the upper tapered portion with respect to a vertical direction.

6. The system of claim 1, wherein the actuator comprises a solid piece of material configured to be deformed upon actuation of the lock ring.

7. The system of claim 1, wherein the seal assembly further comprises a shearable component coupling the actuator to the main body of the seal assembly.

8. The system of claim 1, wherein the seal assembly further comprises a seal coupled to a lower end of the main body of the seal assembly.

9. A system, comprising:

a wellhead;

a casing hanger disposed in the wellhead;

a seal assembly configured to be installed in the wellhead for retaining the casing hanger within the wellhead, wherein the seal assembly comprises:

a main body;

a lock ring coupled to the main body and configured to expand radially outward into a profile on an inner diameter of the wellhead; and an actuator, wherein the actuator is capable of transferring an axial force from the actuator into outward radial expansion of the lock ring until a tapered portion of the lock ring directly contacts a corresponding tapered portion of the profile;

wherein the actuator comprises:

a first portion configured to remain stationary with respect to the main body during actuation of the lock ring; and a second portion configured to be moved in an axial direction with respect to the first portion for actuating the lock ring, wherein a shoulder of the first portion is disposed directly above the lock ring, and wherein the lock ring is axially constrained between the shoulder and an upward facing surface of the main body.

10. The system of claim 9, wherein the seal assembly further comprises a seal coupled to a lower end of the main body of the seal assembly for sealing an annulus between the casing hanger and the wellhead.

11. A method, comprising:

positioning a seal assembly into a wellhead, the seal assembly comprising a main body, a lock ring coupled to the main body, and an actuator;

moving at least a portion of the actuator in an axial direction with respect to the main body to contact the lock ring;

expanding the lock ring radially outwardly into a profile on an inner diameter of the wellhead via the actuator; and retaining a casing hanger in the wellhead via the seal assembly;

wherein the actuator is configured to transfer an axial force from the actuator into outward radial expansion of the lock ring until a tapered portion of the lock ring directly contacts a corresponding tapered portion of the profile;

wherein the actuator comprises:

a first portion configured to remain stationary with respect to the main body during actuation of the lock ring; and a second portion configured to be moved in an axial direction with respect to the first portion for actuating the lock ring, wherein a shoulder of the first portion is disposed directly above the lock ring, and wherein the lock ring is axially constrained between the shoulder and an upward facing surface of the main body.

12. The method of claim 11, wherein moving at least one portion of the actuator in an axial direction comprises moving the second portion in the axial direction while maintaining the first portion stationary with respect to the main body.

13. The method of claim 12, wherein moving the second portion in the axial direction comprises moving a stepped profile on a radially inward facing surface of the second portion with respect to a stepped profile on a radially outward facing surface of the first portion.

14. The method of claim 12, wherein moving the second portion in the axial direction comprises ratcheting threads on a radially inward facing surface of the second portion along corresponding threads on a radially outward facing surface of the first portion.

15. The method of claim 11, further comprising:

engaging a lower tapered portion of a radially outward facing surface of the actuator with a tapered portion along a radially inward facing portion of the lock ring to push the lock ring; and then, engaging an upper tapered portion of the radially outward facing surface of the actuator with the tapered portion along the radially inward facing portion of the lock ring, wherein the upper and lower tapered portions are at different angles.

16. The method of claim 11, further comprising deforming the actuator in response to pushing the actuator into contact with the lock ring.

17. The method of claim 11, further comprising applying a pre-load to the casing hanger via the seal assembly.

18. The method of claim 11, further comprising:

sealing an annulus between the casing hanger and the wellhead via a seal coupled to the main body of the seal assembly; and deterring movement of the seal in an axial direction via the connection between the casing hanger, the seal assembly, and the wellhead.

* * * * *